US006223367B1

(12) United States Patent
French et al.

(10) Patent No.: US 6,223,367 B1
(45) Date of Patent: May 1, 2001

(54) STADIUM BLANKET

(76) Inventors: Katherina Grace French, 38020 WCR 45, Eaton, CO (US) 80615; Dianna Lynn Benson; Natalie Rhene Vandevuss, both of 6714 E. Amherst Ct., Highlands Ranch, CO (US) 80126

( * ) Notice: Subject to any disclaimer, the term of this patent is extended or adjusted under 35 U.S.C. 154(b) by 0 days.

(21) Appl. No.: 09/393,104

(22) Filed: Sep. 9, 1999

Related U.S. Application Data

(60) Provisional application No. 60/099,609, filed on Sep. 9, 1998.

(51) Int. Cl.[7] ..... A47G 9/06

(52) U.S. Cl. ..... 5/419; 5/485; 5/656; 383/4

(58) Field of Search ..... 5/417, 419, 420, 5/485, 656; 383/4

(56) References Cited

U.S. PATENT DOCUMENTS 2,045,784 * 6/1936 Leve ..... 5/419
2,540,165 * 2/1951 Fiel ..... 383/4
4,164,275 * 8/1979 Davis ..... 5/417 X
4,278,719 * 7/1981 Sarnecki ..... 5/420 X
5,730,529 * 3/1998 Fritz et al. ..... 383/4
5,774,912 * 7/1998 Dominque ..... 5/419
5,785,219 * 7/1998 Kraft ..... 5/419 X
5,956,768 * 9/1999 Pearson ..... 5/485
5,970,542 * 10/1999 Mays ..... 5/485

* cited by examiner

*Primary Examiner*—Michael F. Trettel
(74) *Attorney, Agent, or Firm*—Rick Martin; Patent Law Offices of Rick Martin P.C.

(57) ABSTRACT

The present invention is a stadium blanket having an attached storage bag. The blanket is of sufficient size to allow the blanket to protect a user from the elements or to be used as a sleeping bag. The blanket has a water repellent liner on one side and a fleece for warmth on the other. The storage bag may also be used as a pillow and as an anchor when placed around a users feet. The storage bag may also be lined to enclose and warm a users feet. When not in use, the blanket is folded and enclosed within the storage bag for ease of storage or carrying.

18 Claims, 3 Drawing Sheets

STADIUM BLANKET

CROSS REFERENCE APPLICATIONS

This application is a non-provisional application claiming the benefits of provisional application Ser. No. 60/099,609 filed on Sep. 9, 1998.

FIELD OF THE INVENTION

The field of the invention relates to blankets, more particularly to blankets having an attached storage bag.

BACKGROUND OF THE INVENTION

The nature and use of blankets is well known. The prior art comprises various types and styles of blankets intended for any number of uses. These include uses as bedclothes, for use as a warmer or comforter, for use in emergency situations in order to warm a victim and for a covering. All of these either have no transporting bag or they have a bag from which the blanket is removed prior to use.

What is needed is a blanket having attached storage bag. What is needed is a blanket having an attached storage bag which can be used as a pillow. What is needed is a blanket having an attached storage bag having a closer. What is needed is a blanket having a size which allows the blanket to be used as a sleeping bag. What is needed is a blanket having a liner to protect a user from damp conditions. What is needed is a blanket having an attached storage bag that is water repellant. What is needed is a blanket having a liner to protect a user from cold conditions. The present invention meets these and other needs.

SUMMARY OF THE INVENTION

The primary aspect of the invention is to provide a stadium blanket having an attached storage bag.

Another aspect of the present invention is to provide a stadium blanket having an attached storage bag which can be used as a pillow.

Another aspect of the present invention is to provide a stadium blanket having a blanket which can be used as a sleeping bag.

Another aspect of the present invention is to provide a stadium blanket having an attached storage bag which has a closer.

Another aspect of the present invention is to provide a stadium blanket having a liner to protect a user from damp conditions.

Another aspect of the present invention is to provide a stadium blanket having an attached storage bag that acts as an anchor when a users feet are placed inside.

Another aspect of the present invention is to provide a stadium blanket having a liner to protect a user from cold or damp conditions.

Other aspects of this invention will appear from the following description and appended claims, reference being made to the accompanying drawings forming a part of this specification wherein like reference characters designate corresponding parts in the several views.

The invention comprises a blanket and storage or bag case. The bag case is of a size sufficient to allow the blanket to be stored within the bag case when the blanket is not in use. The bag case has a zipper to close it. The blanket comprises an insulating side and a water repellent side. The blanket is of a size to allow it to be used as a sleeping bag if desired by a user. The bag case can contain clothes or other soft articles for use as a pillow. The bag case may be lined in order to allow a user to warm his or her feet.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
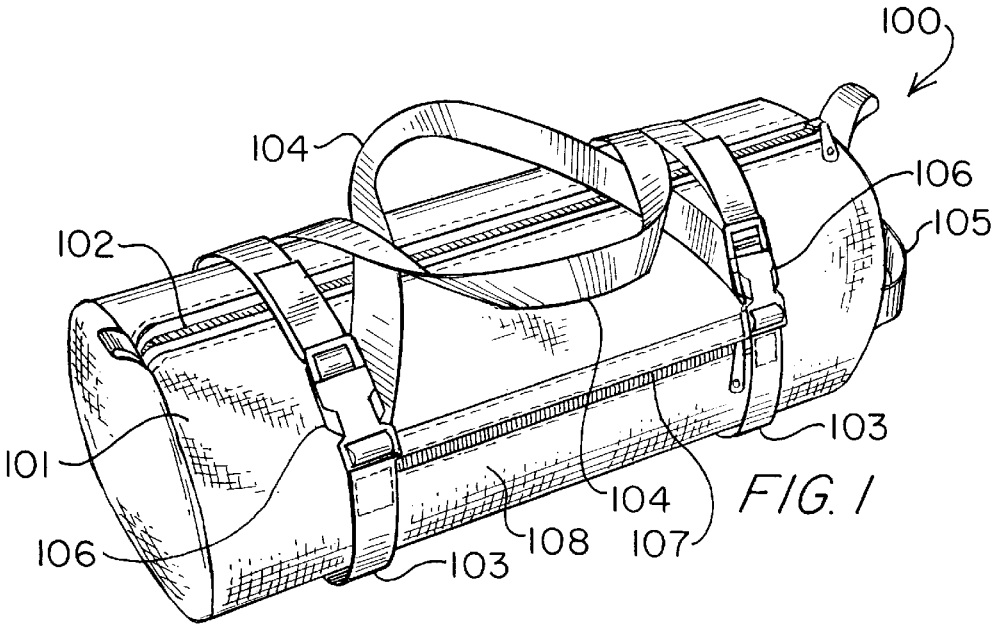
FIG. 1 is a top perspective view of the preferred embodiment.
Figure 8:
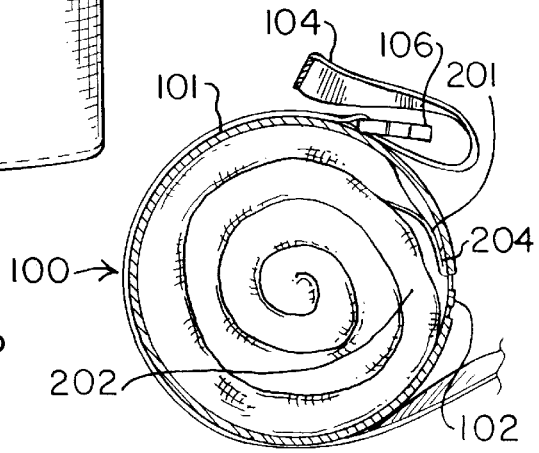
FIG. 8 is a side elevation view of the preferred embodiment in the fully stored position.

FIG. 1 is a top perspective view of the preferred embodiment. Stadium blanket 100 is shown. Bag case 101 comprises zipper 102 or other suitable closure known in the art. Bag case 101 may comprise a nylon material or any other material suitable for use as a carrying bag. Bag case 101 may comprise any water repellent material known in the art. In the closed position, bag case 101 fully contains the blanket (as shown in FIG. 8). Structural integrity is afforded by straps 103 which enclose the circumference of bag case 101. Straps 103 may comprise any material suitable for enclosing or containing items, such as a nylon strap. Straps 103 close upon the bag case 101 by buckles or snaps 106 or other suitable closure known in the art. The stadium blanket 100 is carried by strap handles 104 or other suitable handles known in the art. The stadium blanket may also be carried by handle 105. Compartment 108 is integral to bag case 101. Compartment 108 is closed by zipper 107 or other suitable closure known in the art. Compartment 108 may have key chains (not shown) or other similar clips attached within.

Figure 2:
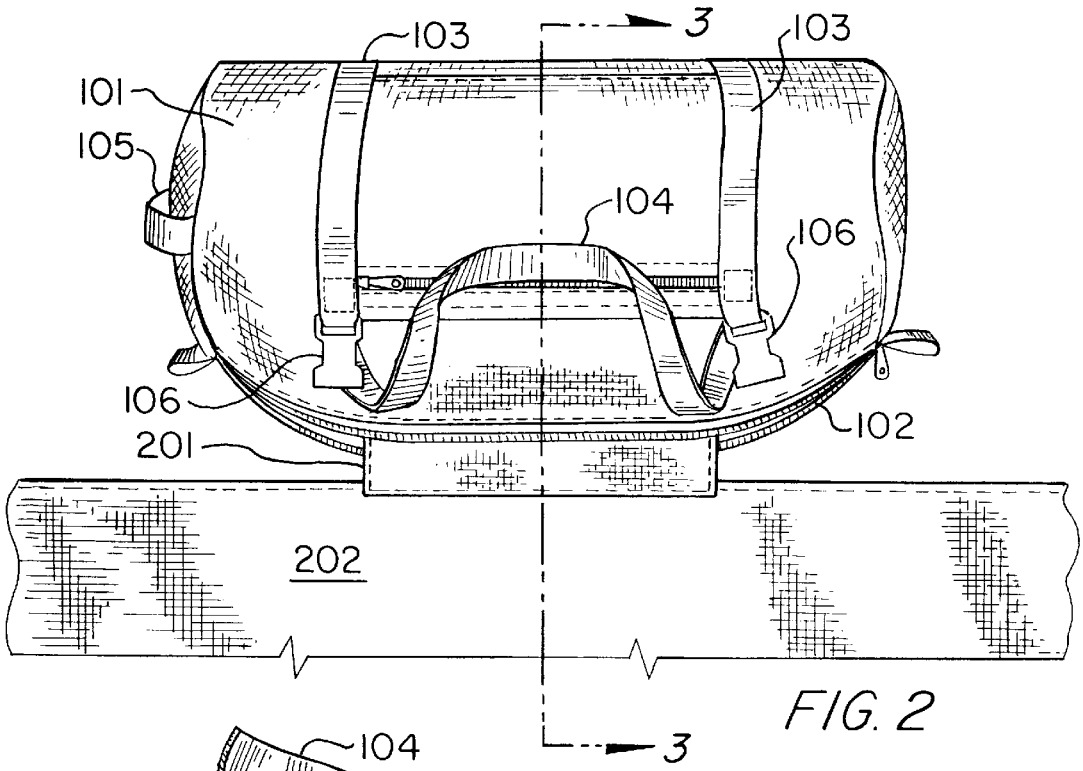
FIG. 2 is a top plan view of the preferred embodiment.
Figure 3:
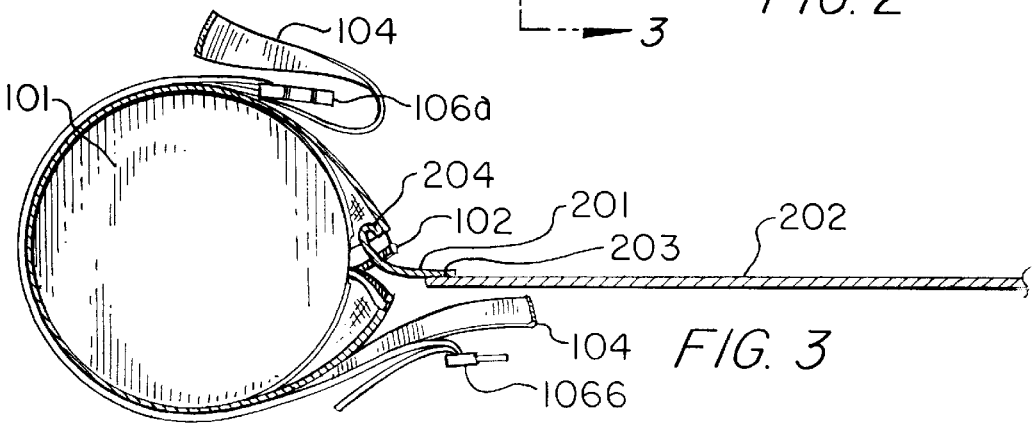
FIG. 3 is a side elevation view of the preferred embodiment viewed along line 3—3 of FIG. 2.

FIG. 2 is a top plan view of the preferred embodiment. Zipper 102 is shown in the open position. Blanket 202 is partially depicted. Blanket 202 is connected to the bag case 101 by tab 201. FIG. 3 is a side elevation view of the preferred embodiment viewed along line 3—3. Blanket 202 is shown connected to bag case 101 by tab 201. Tab 201 is attached to bag case 101 by being sewn into zipper seam 204. In an alternate embodiment, blanket 202 is detachable from bag case 101. In the alternate embodiment, blanket 202 is attached to bag case 101 by a zipper (not shown) or any other detachable connector(s) known in the art.

Figure 4:
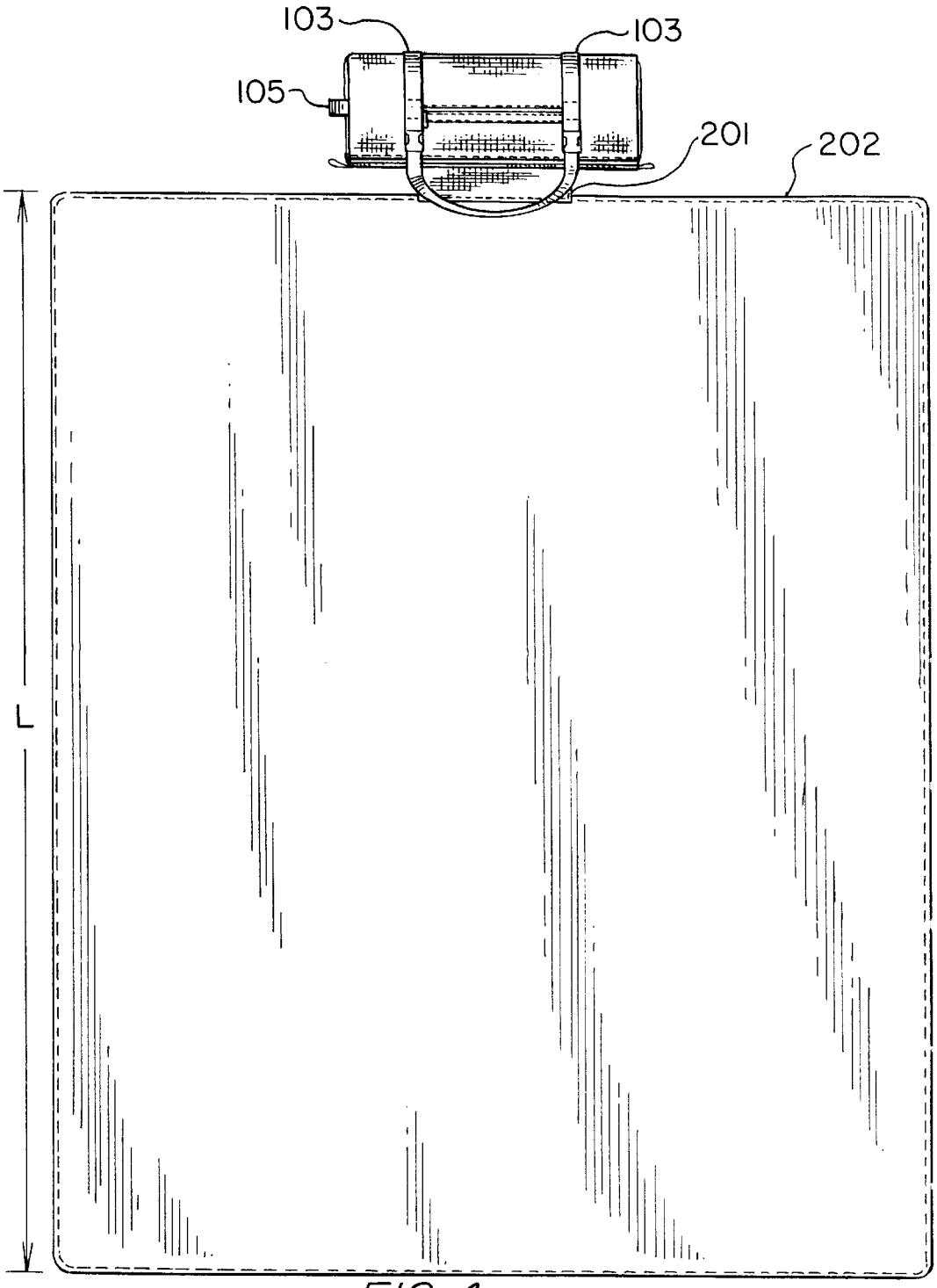
FIG. 4 is a top plan view of the preferred embodiment in the open position.

FIG. 4 is a top plan view of the preferred embodiment in the open position. Blanket 202 is shown connected to bag case 101 by tab 201. Blanket 202 may be of any size sufficient to provide protection for a user from the elements. Length L is preferably long enough to allow a user to use the invention for sleeping. When not in use, blanket 202 is stored within bag case 101. Blanket 202 may comprise any appropriate natural fiber such as wool, or any appropriate synthetic material such as Gortex® used for warmth or protection from rain, snow or the like. Blanket 202 and bag case 101 are also light weight and can be machine washed.

Figure 5:
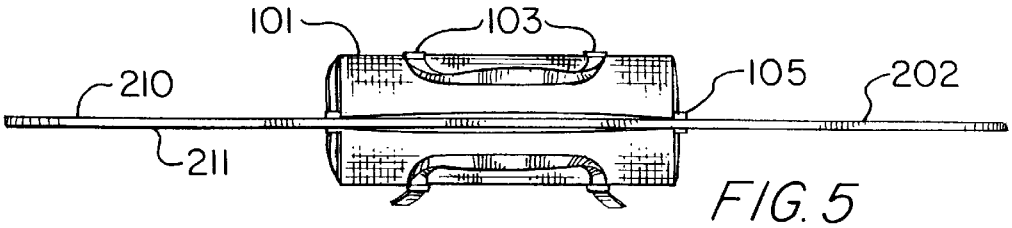
FIG. 5 is a back elevation view of the preferred embodiment.

FIG. 5 is a back elevation view of the preferred embodiment. Blanket 202 aligns substantially horizontally with a major axis of bag case 101 such that bag case 101 may be filled with clothes or any other soft items thereby allowing for use as a pillow or cushion. The storage bag may also be lined with a natural or synthetic material to enclose and warm a user's feet. Further, inserting a users feet into the bag case 101 also serves to better anchor the blanket in windy conditions. Polar fleece 210 or other synthetic or natural fiber for giving insulating warmth is on one side of the blanket 202. The side opposite the polar fleece 210 is a water repellent liner 211 for keeping a user dry in damp or rainy conditions.

Figure 6:
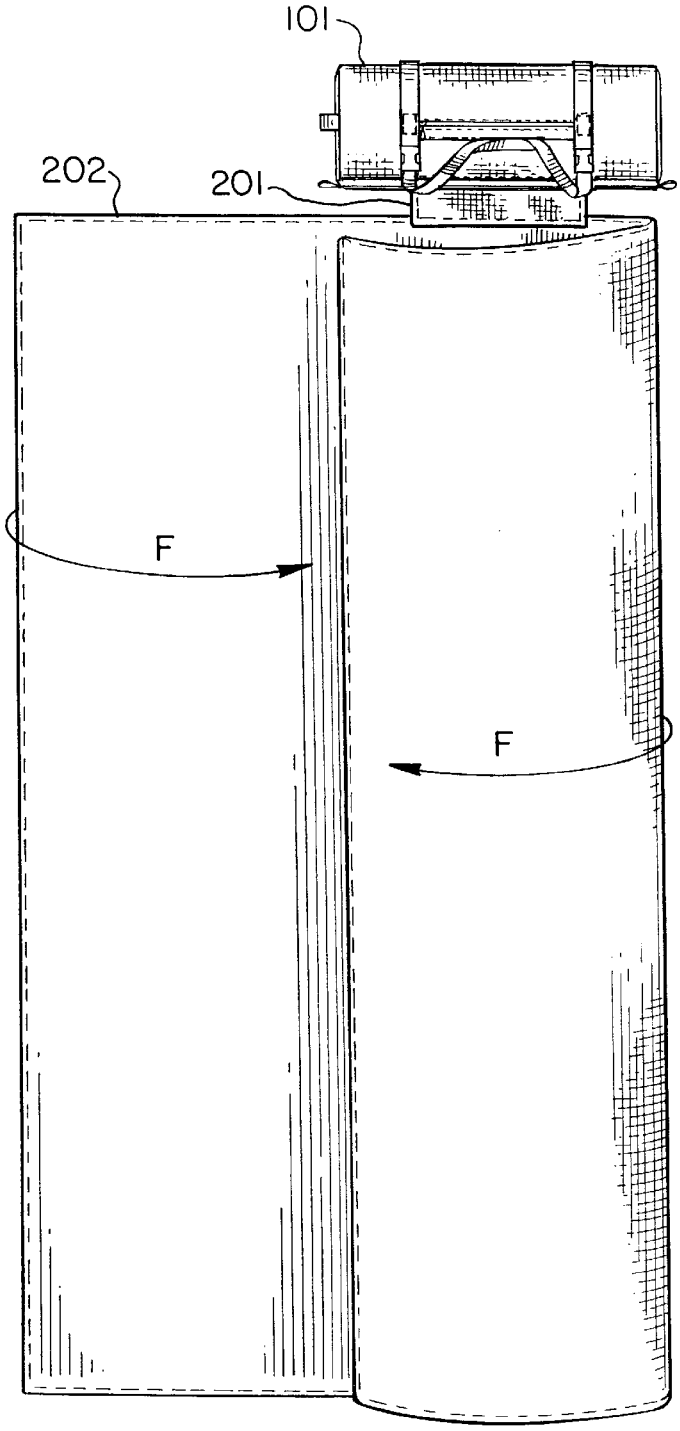
FIG. 6 is a top plan view of the preferred embodiment showing folding of the blanket.

FIG. 6 is a top plan view of the preferred embodiment showing folding of the blanket. Blanket 202 is shown being folded longitudinally into thirds F, although any number of folds are acceptable in order to achieve insertion of blanket 202 into bag case 101. Blanket 202 may also be inserted into the bag case 101 in a "stuff-sack" fashion without folding at all.

Figure 7:
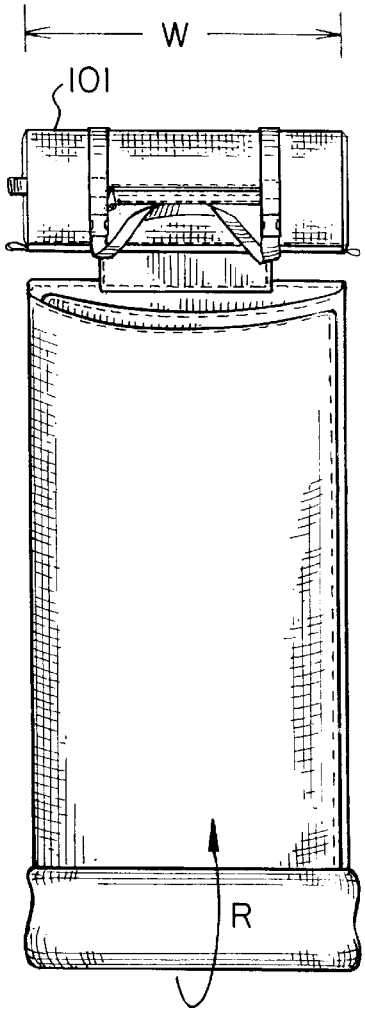
FIG. 7 is a top plan view of the preferred embodiment showing folding of the blanket.

FIG. 7 is a top plan view of the preferred embodiment showing rolling of the folded blanket. Blanket 202 is shown folded to an overall width that substantially equates with the width W of the bag case 101. Blanket 202 is then rolled up R toward the bag case 101.

FIG. 8 is a side elevation view of the preferred embodiment in the fully stored position. Blanket 202 is shown fully rolled and stored within bag case 101. Bag case 101 is of a size sufficient to fully contain rolled blanket 202. Tab 201 is also contained within bag case 101. Zipper 102 is then closed. Buckles or snaps 106 are then also closed to secure the blanket 202 within the bag case 101. Handles 104 are used to carry the stadium blanket 100.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A stadium blanket comprising:

a case having an opening;

a blanket attached to the case, said blanket having a water repellent first side and an insulating second side;

the case being of a size sufficient to completely contain the blanket or a pair of adult human feet; and the case further comprising an insulating lining, functioning to allow the case to be used as a foot warmer while the blanket is used as a body warmer.

2. The stadium blanket of claim 1 further comprising a closure on said opening whereby said opening may be closed.

3. The stadium blanket of claim 2, wherein the closure is a zipper.

4. The stadium blanket of claim 2, wherein the closure is a hook and loop fastener.

5. The stadium blanket of claim 1, wherein the blanket has a removable attachment to the case.

6. The stadium blanket of claim 5, wherein the removable attachment is a zipper.

7. The stadium blanket of claim 1, wherein the case is made from water repellant material.

8. The stadium blanket of claim 1, wherein the case further comprises handles.

9. The stadium blanket of claim 8, wherein the handles are nylon straps.

10. The stadium blanket of claim 8, wherein the case further comprises cinch straps around an exterior of the case functioning to provide structural integrity.

11. The stadium blanket of claim 1, wherein the blanket extends from an edge attached to said case for a length L.

12. The stadium blanket of claim 11, wherein length L is at least 6 feet.

13. The stadium blanket of claim 1, wherein the case further comprises a side compartment.

14. A multi-mode blanket and case comprising:

a first mode having a lengthwise tri-fold in a blanket, and a roll of the tri-fold blanket, functioning as a pillow;

a second mode having a flexible case attached to said tri-folded blanket, said case having a length about a width of a single tri-fold and being lined for insulation, said case functioning as a travel mode;

a third mode having said blanket unfolded, thereby providing both a general blanket and an empty case as a foot warmer, wherein said empty case has a size adequate to house a pair of adult human feet; and a fourth mode having the blanket partially unfolded functioning as a sleeping pad and blanket while said case has a stuffing for use as a pillow.

15. The apparatus of claim 14, wherein the case has a liner and a waterproof skin.

16. The apparatus of claim 14, wherein the case has a handle and a cinch strap.

17. The apparatus of claim 15, wherein the case has a handle and a cinch strap.

18. The apparatus of claim 14, wherein the case has a removable attachment to the blanket.

* * * * *